United States Patent [19]

Krause

[11] 3,962,890

[45] June 15, 1976

[54] STRAIGHT KNITTING MACHINE COMPRISING ROTATING SLIDING HEADS

[75] Inventor: Erich Krause, Bopfingen, Germany

[73] Assignee: Universal Maschinenfabrik Dr. Rudolf Schieber KG, Aalen, Germany

[22] Filed: Mar. 5, 1975

[21] Appl. No.: 555,903

[30] Foreign Application Priority Data

May 13, 1974 Germany ..... 2423043
Nov. 29, 1974 Germany ..... 2456557

[52] U.S. Cl. ..... 66/64; 66/125 R
[51] Int. Cl.[2] ..... D04B 7/04
[58] Field of Search ..... 66/125, 157, 60, 64

[56] References Cited

UNITED STATES PATENTS

| | | | |
|---|---|---|---|
| 284,905 | 9/1883 | Salisbury | 66/64 X |
| 528,810 | 11/1894 | Salisbury | 66/64 |
| 2,705,408 | 4/1955 | Mehners | 66/64 |
| 2,821,073 | 1/1958 | Mehnert | 66/64 |
| 3,751,944 | 8/1973 | Krause | 66/64 |

FOREIGN PATENTS OR APPLICATIONS

| | | | |
|---|---|---|---|
| 44,888 | 4/1966 | Germany | 66/64 |

*Primary Examiner*—Ronald Feldbaum
*Attorney, Agent, or Firm*—Sughrue, Rothwell, Mion, Zinn & Macpeak

[57] ABSTRACT

A straight knitting machine includes a plurality of sliding heads 1 driven around a guide track 2 by chain and sprocket means 3, 5. A plurality of holders 8 for yarn spools 9 are positioned above their associated sliding heads and are driven around guide tracks 10, 11 by chain and sprocket means 12, 14 coupled to the same drive shaft 15 as the chain and sprocket means 3, 5. Electrical connections for safety switches and thread delivery motors are made by sliding contacts on the heads 1 which engage stationary contacts on the straight portions of the guide path.

9 Claims, 6 Drawing Figures

STRAIGHT KNITTING MACHINE COMPRISING ROTATING SLIDING HEADS

BACKGROUND OF THE INVENTION

1. Field of the Invention

The present invention relates to a straight knitting machine comprising rotating sliding heads and yarn spools which rotate together with the individual sliding heads along the guide track of the latter.

2. Description of the Prior Art

In the case of known straight knitting machines of this type, the yarn spools are moved on the sliding heads and are rigidly connected thereto. An arrangement of this type has various disadvantages.

In the first place, the spools cannot be disposed above one another as otherwise the holders for the thread tension devices would be too high and there would be a risk of these vibrating excessively. As a result, it would be impossible to ensure that the thread was supplied in a completely effective manner. Secondly, when the yarn spools are arranged on the sliding heads, the spacing between the sliding heads cannot be as narrow as desired if sufficient yarn spools are to be driven simultaneously. Lastly, it is difficult to remove the sliding heads from their guide track if the holders for the yarn spools are directly connected to the sliding heads.

SUMMARY OF THE INVENTION

The object of the present invention is to provide a straight knitting machine comprising rotating sliding heads which is constructed in such a way with respect to the simultaneously displaced yarn spools that the above-mentioned disadvantages do not occur.

According to the present invention this problem is solved in that the sliding heads and the yarn spool holders together with the associated thread guide elements are mounted on separate, parallel guide paths and in that the sliding heads and the yarn spool holders are are driven by two drive means operating in synchronism in such a way that they rotate synchronously in parallel. The sliding heads and the yarn spool holders are preferably driven via endless belts.

To ensure that there is synchronous operation of the sliding heads and yarn spool holders, the two driving chains are advantageously driven via chain wheels disposed on a common drive shaft and the axes of the respective oppositely disposed chain wheels are mounted in such a way that each chain can be tightened individually.

The yarn spool holders move especially smoothly if the yarn spools with the accompanying thread guide elements are mounted on at least two guide tracks. The yarn spools are advantageously disposed adjacent to one another and above one another. In this way, sufficient material, that is, sufficient thread can be carried along for each sliding head even when there are a large number of sliding heads and when the sliding heads are disposed in close succession.

To obtain a stable holder which is secure in its guide, the holder is advantageously designed to receive the yarn spools for a plurality of sliding heads.

Thread delivery means are advantageously provided between the spools and the sliding heads. This ensures that the thread is reliably guided between the yarn spools and the sliding heads.

For the electrical connection of safety switches on the sliding heads and/or on the thread guide elements and of thread storage and feed elements, sliding contacts are advantageously provided on the sliding heads and contact bars are provided on the straight stretches of the guide track of the sliding heads and spool holders. Contact is thus only made on these straight stretches. Flexible connecting wires are advantageously provided to electrically connect the individual sliding heads and the sliding heads and the yarn spool holders. On the one hand, this ensures that full contact is maintained with the sliding heads and the yarn spool holders when they are located on the curved sections, and, on the other hand, it reduces the number of sliding contacts required since it is not essential to provide every sliding head with all the contacts.

Another feature of the invention consists in that the yarn spool holders comprise at least one part with yarn spools which is adapted to be pivoted with respect to a base portion disposed on the guide track. All the yarn spools can be mounted on pivotable parts of the holder.

As a result, the holders and the yarn spools are readily accessible for loading thread and possibly for correcting errors. This arrangement also makes it possible for the thread tension to be adjusted without pulling thread from the spool.

The holder parts are advantageously adapted to be pivoted outwards, thus rendering the yarn spools even more accessible.

The pivotable parts of the holders are advantageously pivotably connected with the base parts of the holders via swivel unions. The pivotable parts are also advantageously releasably connected to the base parts by means of capstan-head screws.

Other objects, features and advantages of the present invention will be made apparent from the following detailed description of certain embodiments thereof which is provided with reference to the accompanying drawings.

DESCRIPTION OF THE PREFERRED EMBODIMENTS

Figure 1:
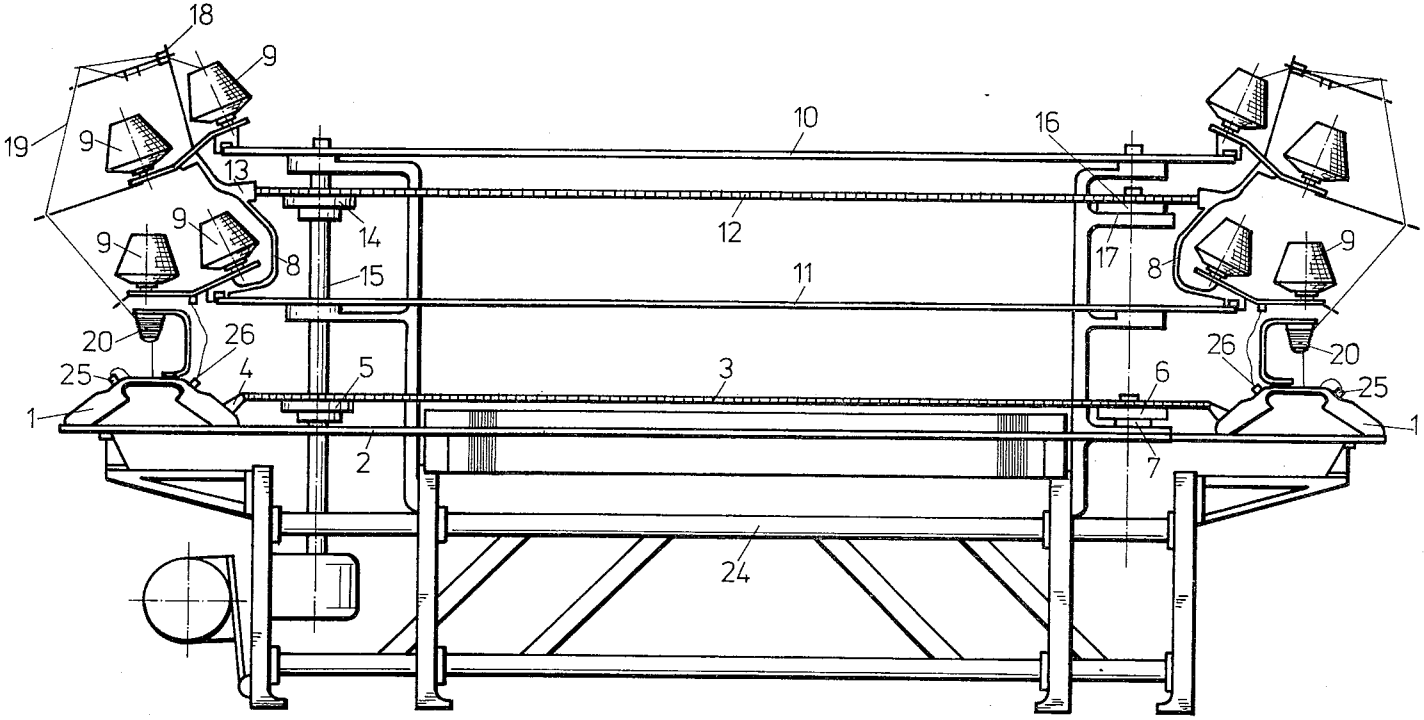
FIG. 1 shows a diagrammatic side view of a straight knitting machine comprising rotating sliding heads.

In the straight knitting machine represented in the drawings, the sliding heads 1 — of which FIG. 1 only shows the two outer sliding heads passing through the curved sections — are displaced on a guide track 2. The sliding heads 1 are driven by an endless chain 3 and are connected to this chain by means of connections 4. The chain passes on one side over a driven chain wheel 5 and on the other side over a chain wheel 6 which can be adjusted together with its bearing 7 in order to retighten the chain 3.

Holders 8 for the yarn spools 9 move along guide paths 10 and 11 and are driven by an endless chain 12. The holders 8 are connected to the chain 12 by means of the connections 13. The chain 12 is driven via a chain wheel 14 which is mounted with the chain wheel 5 on a common drive shaft 15. On the other side, the chain 12 passes over a chain wheel 16 which can be adjusted together with its bearing 17 in order to tighten the chain. The chain wheels 6 and 16 are independently adjustable.

Thread guide elements 18 are provided on the holder 8. These guide elements supply the thread 19 to the sliding head 1. The thread 19 is advantageously supplied to the sliding head 1 via a thread storage and feed element 20 provided on the sliding head 1, as shown in the embodiment represented in the drawing.

Automatic safety switches are provided on the sliding heads 1 and/or on the thread guide elements 18. Such automatic safety switches are old and well known in the art and accordingly have not been illustrated in the present application. These switches are provided to shut down the operation of the knitting machine when a yarn spool is exhausted, a yarn breaks, a yarn has improper tension, a yarn has a knot or a needle breaks. These safety switches are electrically connected to the base frame (24) of the machine by means of sliding contacts 21 and 22 which are provided on the sliding heads 1. These sliding contacts 21 and 22 slide on contact bars 23 and 27. The contact bars 23 and 27 provided on the base frame are diposed only on the straight parts of the guide tracks of the sliding heads and spool holders. Flexible connecting wires 25 are provided between the sliding heads to electrically connect the sliding heads when they are located on the curved sections. The sliding heads 1 are also connected to the safety switches of the thread guide elements via flexible connecting wires 26.

Additional sliding contacts 28, 29 and 30 which slide on corresponding contact bars 31, 32 and 33 are provided on the sliding heads 1. Current is supplied to the three phase motor of the thread storage and feed elements 20 via these three sliding contacts and their associated contact bars. The sliding heads are also connected together by way of corresponding flexible wires to supply current to the three phase motors of the thread storage and feed elements 20.

Owing to the fact that flexible connecting wires are used to connect together the sliding heads 1 and to connect the sliding heads 1 to the thread guide elements 18, it is possible to reduce the number of sliding contacts on the sliding heads themselves, as, for example only every fifth sliding head 1 must be provided with sliding contacts 21, 22, 28, 29, 30.

Figure 2:
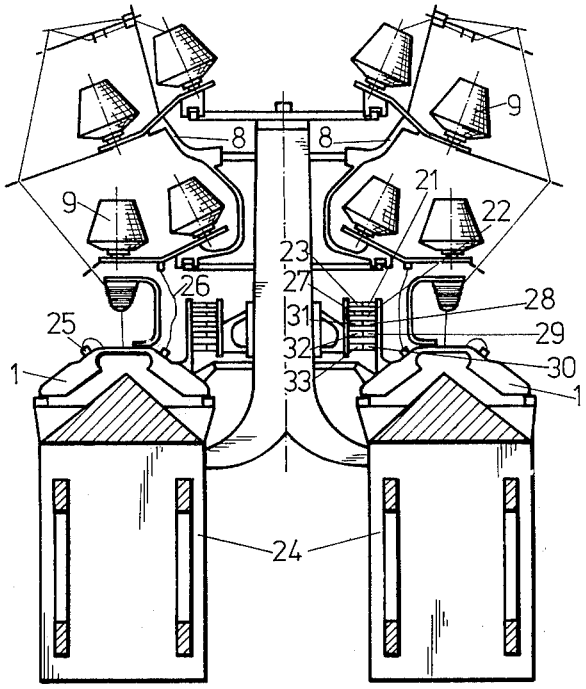
FIG. 2 shows a cross-sectional view through the straight knitting machine shown in FIG. 1.
Figure 3:
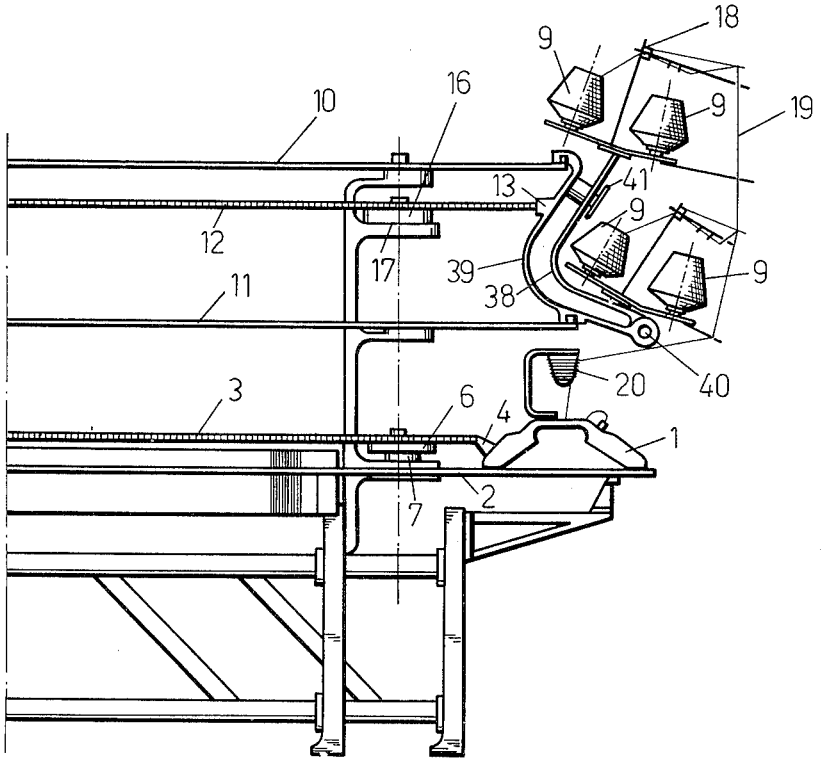
FIG. 3 is a diagrammatic partial side view of a modified straight knitting machine comprising rotating sliding heads and a pivotable part for supporting yarn spools disposed in its inwardly pivoted position.
Figure 4:
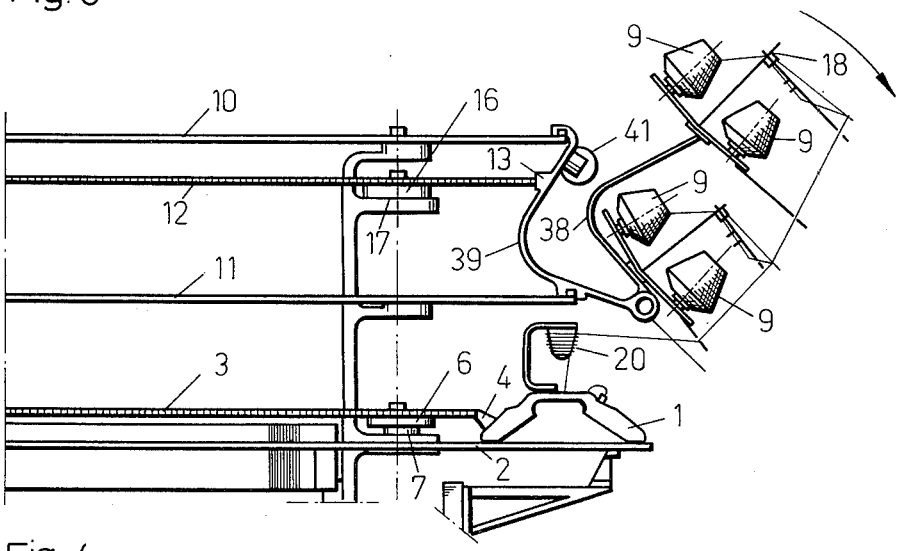
FIG. 4 is a view similar to that shown in FIG. 1 with the spool supporting part in the course of being pivoted outwards.

The difference between the straight knitting machine represented in FIGS. 3 and 4 and the machine represented in FIGS. 1 and 2 consists in that the holders for the yarn spools 9, in the embodiment shown in FIGS. 3 and 4 consist of a base part 39 mounted on the guide tracks 10 and 11 and a supporting part 38 which is pivotably mounted on the base part 39.

The supporting part 38 is pivotably or swivellably connected to the base part 39 via a swivel union 40. A capstan-head screw 41 which releasably connects the supporting part 38 to the base part 39 is provided to prevent unintentional pivoting of the part 38. FIG. 1 shows the supporting part 38 pivoted inwards and FIG. 2 shows the part 38 pivoted outwards from the base part 39 after the capstan-head screw 41 has been released.

Figure 5:
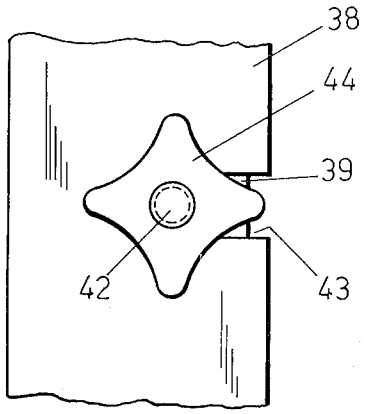
FIG. 5 is a plan view of a capstan-head screw connection with the capstan-head screw pivoted inwards.
Figure 6:
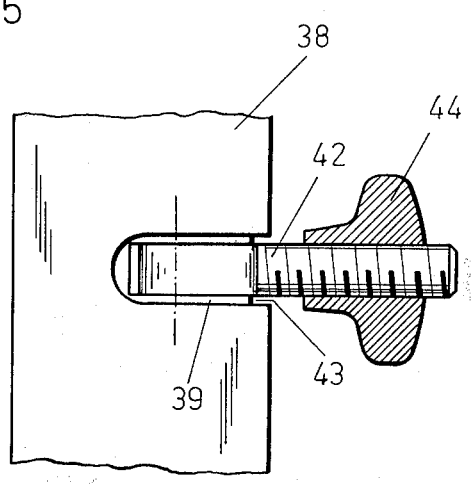
FIG. 6 is a plan view of a capstan-head screw connection similar to that shown in FIG. 3 with a partial sectional view of the outwardly pivoted capstan-head screw.

FIG. 5 shows a plan view of a capstan-head screw connection. A screw bolt 42 which is pivotably secured to the base part 39 is inserted in a slot 43 in the supporting part 38 and a hand nut 44 is tightened on the screw bolt 42.

FIG. 4 shows the capstan-head bolt in the outwardly pivoted state. Upon loosening the hand nut 44, the screw bolt 42 could be pivoted out of the slot 43, thus releasing the part 38 with respect to the base part 39. In this way the supporting part 38 can be pivoted about the swivel joint 40.

What is claimed is:

1. A straight knitting machine comprising first endless guide track means, a plurality of head means slidably mounted on said first guide track means for actuating the needles of said machine, first drive means for rotating said head means about said endless track means, second and third endless guide track means disposed above and in parallel spaced apart relation to said first endless guide track means, a plurality of spool holder means each adapted to hold a plurality of spools slidably mounted on said second and third guide track means adjacent respective head means and second drive means operatively connected to said first drive means for moving said head means and said spool holder means synchronously in parallel about said endless track means.

2. A straight knitting machine as set forth in claim 1 wherein said first and second drive means include first and second endless chain means, repectively, disposed in operative driving relation with said head means and said spool holder means.

3. A straight knitting machine as set forth in claim 2 wherein each chain means is entrained about a drive sprocket, said sprockets being mounted on a common drive shaft and means for adjusting the tension of said first and second chain means.

4. A straight knitting machine as set forth in claim 1 wherein a plurality of head means are operatively associated with a single spool holder means.

5. A straight knitting machine as set forth in claim 1 further comprising thread storage and feed means mounted on each head means.

6. A straight knitting machine as set forth in claim 1 further comprising a plurality of stationary contact bars mounted on said machine and a plurality of contacts on each of said head means adapted to slidably engage said stationary contact bars for transmitting electrical signals between said machine and said head means.

7. A straight knitting machine as set forth in claim 6 further comprising flexible connecting wire means for electrically interconnecting individual sliding head means and for electrically interconnecting said sliding head means with said spool holder means.

8. A straight knitting machine as set forth in claim 1 wherein each spool holder means is comprised of a first part disclosed in sliding engagement with said second and third guide track means and a second part having said spool holding means thereon pivoted to said first part for movement toward and away from said second and third guide track means.

9. A straight knitting machine as set forth in claim 8 further comprising releasable connecting means for connecting said first and second parts together.

* * * * *